US009384909B2

(12) United States Patent
Jiang

(10) Patent No.: US 9,384,909 B2
(45) Date of Patent: Jul. 5, 2016

(54) STRONG CURRENT STATIC CONTACT DEVICE FOR HIGH VOLTAGE EARTHING SWITCHES

(71) Applicant: JIANGSHAN ELECTRIC TECHNOLOGY DEVELOPMENT CO., LTD., Jiangshan, Zhejiang Province (CN)

(72) Inventor: Chunwei Jiang, Jiangshan (CN)

(73) Assignee: JIANGSHAN ELECTRIC TECHNOLOGY DEVELOPMENT CO., LTD., Jiangshan, Zhejiang Province (CN)

( * ) Notice: Subject to any disclaimer, the term of this patent is extended or adjusted under 35 U.S.C. 154(b) by 37 days.

(21) Appl. No.: 14/375,054

(22) PCT Filed: Oct. 14, 2013

(86) PCT No.: PCT/CN2013/085179
§ 371 (c)(1),
(2) Date: Jul. 28, 2014

(87) PCT Pub. No.: WO2014/071791
PCT Pub. Date: May 15, 2014

(65) Prior Publication Data

US 2015/0034464 A1 Feb. 5, 2015

(30) Foreign Application Priority Data

Nov. 7, 2012 (CN) ..... 2012 2 0581350 U

(51) Int. Cl.
*H01H 1/06* (2006.01)
*H01H 1/42* (2006.01)

(Continued)

(52) U.S. Cl.
CPC . *H01H 1/06* (2013.01); *H01H 1/42* (2013.01); *H01H 1/50* (2013.01); *H01H 31/003* (2013.01); *H01H 2235/03* (2013.01); *H01H 2239/044* (2013.01)

(58) Field of Classification Search
CPC ..... H01H 1/50; H01H 1/06
USPC ..... 200/243–244, 251–252, 275
See application file for complete search history.

(56) References Cited

FOREIGN PATENT DOCUMENTS

CN 201622942 * 11/2010 ..... H01H 1/50
CN 201622942 U 11/2010

(Continued)

*Primary Examiner* — Edwin A. Leon
*Assistant Examiner* — Iman Malakooti
(74) *Attorney, Agent, or Firm* — Jiwen Chen

(57) ABSTRACT

The present invention is the field of electrical elements, related to the technology for improving the connection performance of the static contact device for strong current in high voltage switches, especially for a type of static contact device for strong current in high voltage earthing switches. It includes a base, with two Contact Pieces standing face-to-face on it and vertical to its upper end surface. Outside each of the two Contact Pieces, there is a supporting plate, the lower end of which is firmly fixed on the base. Two groups of coaxially stacking Belleville springs are set between each supporting plate and the contact piece on the same side. By way of setting two groups of Belleville springs on one side, the present invention enlarges the contact surface between the Contact Piece and the moving contact blade, effectively reinforcing the gripping for each other. Compared with the scheme in which a single group of Belleville springs is used on one side with equal pressure, this new scheme can prolongs the products' service life as well as ensure good connection performance of the static contact.

8 Claims, 6 Drawing Sheets

(51) Int. Cl.
*H01H 1/50* (2006.01)
*H01H 31/00* (2006.01)

(56) References Cited

FOREIGN PATENT DOCUMENTS

| | | | | | |
|---|---|---|---|---|---|
| CN | 102044348 | * | 5/2011 | ..... | H01H 1/56 |
| CN | 102044348 | A | 5/2011 | | |
| CN | 202339844 | U | 7/2012 | | |
| CN | 202977183 | U | 6/2013 | | |
| GB | 2190545 | A | 11/1987 | | |
| JP | S6193516 | A | 5/1986 | | |
| WO | WO02080206 | A2 | 10/2002 | | |

* cited by examiner

STRONG CURRENT STATIC CONTACT DEVICE FOR HIGH VOLTAGE EARTHING SWITCHES

This is a U.S. national stage application of PCT Application No. PCT/CN2013/085179 under 35 U.S.C. 371, filed Oct. 14, 2013 in Chinese, claiming the priority benefit of Chinese Application No. 201220581350.8, filed Nov. 7, 2012, which is hereby incorporated by reference.

FIELD OF TECHNOLOGY

This is an invention of electrical elements related to the technology of how to improve the connection performance high voltage switch strong current static contacts. It is particularly related to a type of strong current static contact device for high voltage earthing switches.

TECHNICAL BACKEARTHING

With the development of electrical power technology, there are higher requirements for better capacity of earthing switches in withstanding strong short-circuit current when power is switched on and in quickly cutting off rated short-circuit current when power is switched off. The structure of the static contact device functioning with the moving contact for conducting electricity in high voltage earthing switches usually has a mechanism partly similar to that of the frequently used socket contact, mainly consisting of two clamping pieces (hereinafter referred to as "Contact Pieces" in the present invention) set face-to-face. The gap between two Contact Pieces is slightly less than the blade thickness of the moving contact. The Contact Piece's upper end is equipped with a inwardly protruding ridge by bending inwards, together with a spring provided on the outside of the Contact Piece, achieving the assured connection between moving contact's blade and static contact's Contact Piece via the pressure produced by the elastic deformation of the springs. However, after repeated use, the spring is prone to rigid deformation due to inadequate elasticity of the spring. As a result, the pressure to the Contact Piece would decrease, the reliability of static contact connection would be reduced and the electrical performance of switching device would become poorer. What is worse is that the two Contact Pieces' gap could increase, which may cause the failure of static contact in connecting performance. Therefore, the lifespan of the static contact in common High Voltage earthing switch is generally short.

In order to solve the problems of common static contact mentioned above, the present applicant had an invention published in Chinese Patent CN201622942 of a new-type indoor static contact device of high voltage earthing switch. In that invention, instead of a spring, a supporting plate is installed on the outside of each of the two Contact Pieces, with a group of Belleville springs between the supporting plate and the Contact Piece on the same side. This can generate enough pressure by the elastic deformation of the Belleville springs to compress Contact Pieces tightly, greatly improving the connection reliability of the static contact and extending its service life. However, in more than two years of testing and using the products of that invention, it has been discovered that the testing and completed products have limited force in gripping the moving contact blade and therefore low reliability in the connection. Thus, these products cannot be widely used.

Although increasing Belleville spring's compression distance or using more rigid Belleville springs, such as selecting larger and thicker Belleville spring, all can increase the pressure to the Contact Pieces and thus solves this problem to a certain extent. But the disadvantage of the former is that increasing the compression of distance of the Belleville spring easily causes static contact spring fatigue and shortens the service life of static contact. The disadvantage of the latter is that the more rigid the spring is, the worse the elasticity it has, so that it would increase the resistance when moving contact blade enters the gap between two Contact Pieces and thus similarly affects the connectivity of the static contact.

SUMMARY OF THE PRESENT INVENTION

With the purpose to solve the problem of the existing static contact' weakness in gripping the moving contact blade and its low connection reliability, the present invention provides a solution to reinforce the gripping force without any negative effect on the functioning of the static contact.

It is finally discovered by various experiments that the contact width between moving contact and Contact Pieces is not equal with but far less than the width of Contact Piece itself. From the analysis of contact traces on moving contact blade, it is found that the contact surface is not thread-like (horizontally extending thin rectangle), but point-like (oval shape), horizontally corresponding to the Belleville springs position. Using the static contact that has a single group of Belleville spring, no matter how much pressure is exercised by the Belleville springs onto the Contact Pieces, the experiment results remain the same. This discovery corrected the misunderstanding within the industry over years that the contact surface between Contact Pieces of static contact and moving contact blade is thread-like.

Based on the above findings, the following technical scheme is put forward in view of enlarging the contact surface between the Contact Pieces and the moving contact blade to solve the problem of Contact Pieces' limited force in gripping the moving contact blade. A type of strong current static contact device for high voltage earthing switches is proposed, the device comprising a base with two Contact Pieces mounted face-to-face on the base and the two Contact Pieces being vertical to an upper surface of the base. The outer sides of the Contact Pieces are each respectively installed a supporting plate fixed on the base at the lower part of the supporting plate. Between the upper part of each supporting plate and the Contact Piece on the same side, there are two Belleville springs positioned in coaxial stacking.

It is demonstrated by experiments that by adopting this scheme, the contact surface between Contact Piece and moving contact blade is either oval, which is narrow at near-end but wide at remote-end, or pillow-shaped, which is wide at both ends but narrow in the middle. Evidently, by the way of putting two groups of Belleville springs on one side, the present invention increases the contact surface between the Contact Piece and the moving contact blade, effectively further reinforcing the gripping force between the Contact Piece and the moving contact blade. Compared with the scheme using a single group of Belleville spring on one side that produces equal pressure, the present invention can further increase the products' service life as well as ensure the connection performance of static contact.

On the basis of the principle of the present invention, the axis of the two groups of Belleville spring on the same side should not coincide with each other vertically, namely, one group of Belleville springs' axis shall be staggered to the other horizontally.

In order to ensure symmetrical pressure upon the Contact Pieces on both sides, the axis of the two groups of Belleville springs on the same side should better be coincident respectively with the axes of the two groups of the Belleville spring on the other side, at least vertically.

Normally, the two groups of Belleville springs on the same side should be the same in quantity, in specifications, and be positioned symmetrically on the same level, along the vertical midline of Contact Pieces.

Since the contact between static the Contact Piece and the moving contact blade is not linear, as has been discovered in experiments, using wider Contact Pieces cannot enlarge contact surface; it just wastes raw materials. In order to fix Belleville springs larger in diameter to narrower Contact Pieces so as to save materials for making Contact Pieces and at the same time to ensure adequate pressure, the present invention further proposes a kind of improvement: the two groups of Belleville springs on the same side are not positioned symmetrically on the same horizontal level, namely the axes of the two groups of Belleville springs do not coincide with each other horizontally. In other words, they are staggered to each other longitudinally.

The specific structure is as follows: the setting structure is that two through-holes not along the same horizontal line are provided on Contact Pieces mentioned above. The upper part of the supporting plate is firmly connected with the through-holes by two fixed levers, each of which has a group of Belleville springs set on a fixed lever.

A horizontally extending smooth bulge is set on the inside part of the Contact Piece. The upper part of Contact Piece is in the shape of an arc which is inwardly extruded.

Each group of Belleville springs mentioned above can use the structure of combination, in which two groups of Belleville springs are linked up with each other.

It is best to have a cushion pad made up of silicon rubber set between the two Contact Pieces.

Beneficial Effects:

The device of the present invention adopts the structure in which the supporting plate cooperated with Belleville springs to produce pressure upon Contact Pieces. This kind of structure has the advantages of the static contact with single group of Belleville springs set on one side: low deformation of the Belleville springs, excellent capacity of bearing, buffering and damping as well as keeping the loads to be constant within a certain range of deformation and effectively reducing the vibration produced by electric force while the short-circuit current is passing through. By adopting two groups of Belleville springs on one side, with the springs set staggered to one another, the structure invented not only ensures enough sectional area of the Contact Piece when the power is switched on, but also reduces its width and improves the insulation of the device.

In summary, the present invention has the following advantages: the structure of the device is compact and reasonable, very suitable for use in situations of high current intensity. Apart from ensuring good electrical and mechanical performance of the earthing switch, the present invention will cut down the cost of production by reducing the quantity of copper used, simplify the production process and make the device maximally optimized in electrical and mechanical performance. It is actually a new type of static contact device suitable for use in situations of high current intensity.

EMBODIMENT OF THE PRESENT INVENTION

In order to facilitate a better understanding of the technical proposal put forward by the present invention, a further description, with a specific example, will be given in the following.

Figure 1:
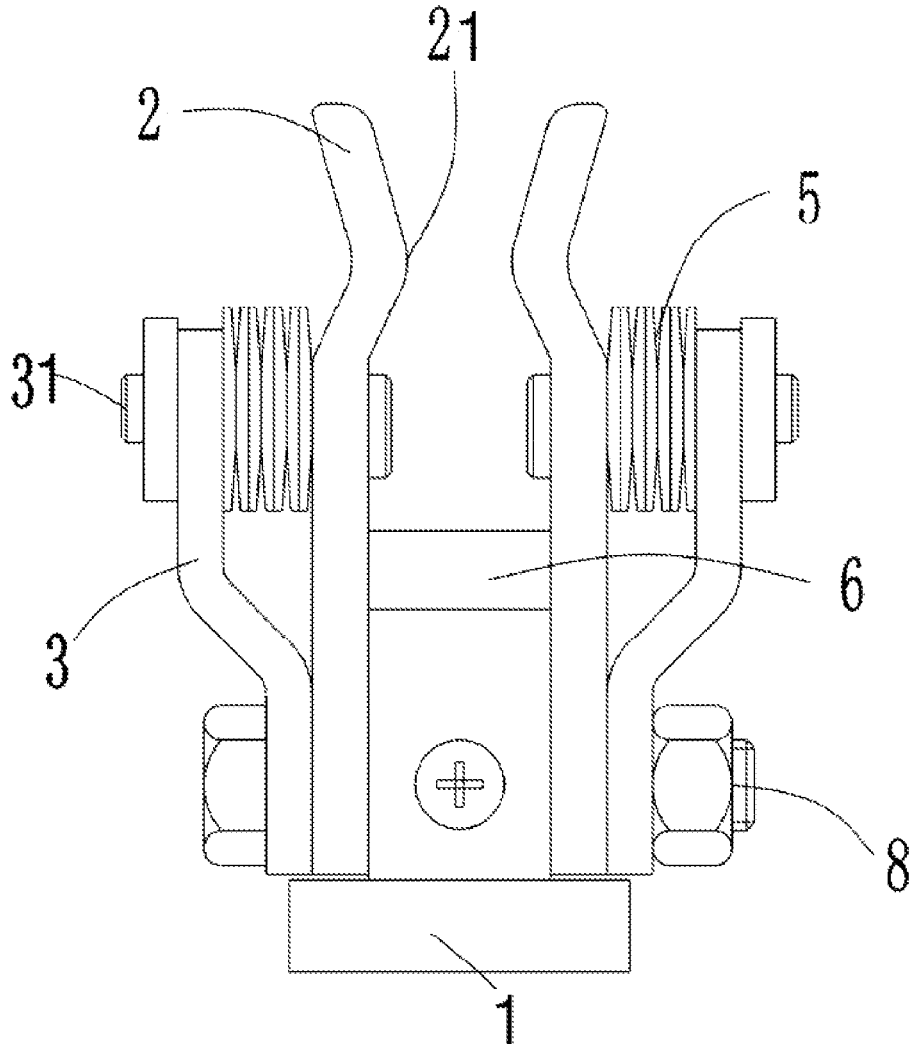
FIG. 1 is a schematic diagram of the front of the specific structure of the static contact mentioned in the present invention (the Belleville spring set in the back is not shown).
Figure 2:
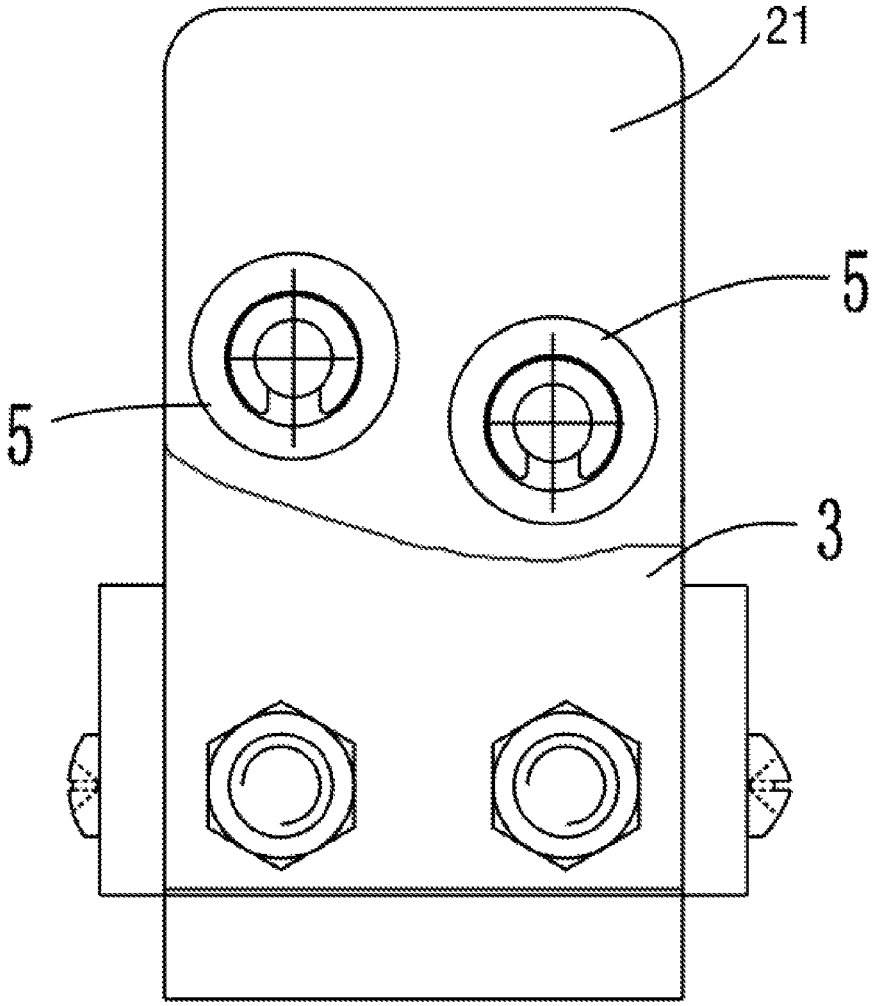
FIG. 2 is a schematic diagram of the side of the specific structure of the static contact mentioned in the present invention.
Figure 3:
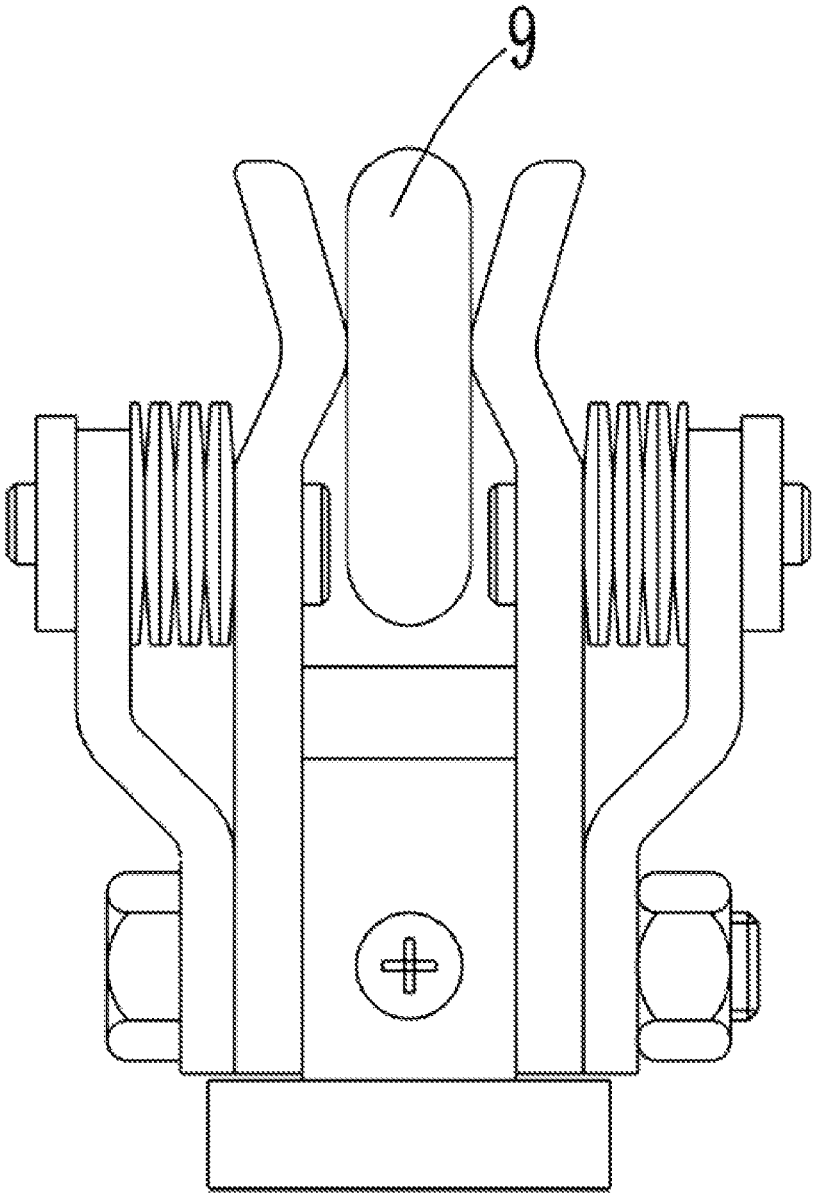
FIG. 3 is a structural diagram of the static contact shown in FIG. 1 in cooperation with moving contact blade.

As shown in the FIGS. 1-3, this is a type of strong current static contact device for high voltage the earthing switch, the device comprising: a base, with two Contact Pieces 2 mounted face-to-face on the base and vertical to an upper surface of the base. The lower ends of the Contact Pieces 2 are firmly fixed on the base 1. The upper part of the Contact Pieces 2 are in the shape of an arc which is inwardly extruded, forming a concave point 21, or an extrusion is directly set at the upper part of the Contact Pieces to ensure the full contact between Contact Piece and moving contact blade. The supporting plate 3 is set on the outer side of the Contact Pieces 2 with two through-holes that are not on the same horizontal line are provided on each of the Contact Pieces. The upper part of the supporting plate is firmly connected with the through-holes by two fixed levers 31, while its lower end is firmly fixed on the base 1 by a check bolt 8. As is shown in the FIG. 2, there are on the same side two groups of Belleville springs 5 set staggered to each other between each supporting plate 3 and its Contact Piece 2. Belleville springs 5 is in the structure of combination, in which two groups of Belleville springs are linked up with each other to increase stability. Belleville springs 5 are sleeved over the fixed levers 31. A cushion pad 6 made up of silicon rubber is set between the two Contact Pieces 2 to reduce the impact of fast switch-on.

Belleville springs are of small volume, heavy load capacity and convenient to combined uses, and they also have the advantage of centralized load transfer. By adopting monolithic combination, multi-lamination combination or mixed combination, a variety of different curves can be obtained. Belleville springs, with the distinguishing features of miniaturization and multi-function, are now widely used instead of cylindrical helical springs in machinery industry, showing. For instance, compared with other types of springs, Belleville springs, compact in the axial space, can bear larger load with smaller deformation, for Belleville springs in the same unit volume have larger deformation ability and better buffering and damping capacity.

The front end of this new-type Contact Piece is pressed into an arc and two Contact Pieces form a trumpet-shaped funnel for the moving contact blade 9 to enter when power is quickly switched on. The inward concave point on the Contact Piece ensures its good contact with moving contact blade 9 when the switch is on, which greatly improves reliability. Similarly, an extrusion directly set inside the upper part of Contact Piece can play the same role to ensure that repeated switch-on and switch-off will not cause any cooperating relaxation between static contact and moving contact. Used in high voltage earthling switches, the electrical and mechanical performance of this device has been greatly improved. It reduces the consumption of raw materials as well. Tests have proved that all the technical specifications met the national standards and the IEC standards.

Figure 4:
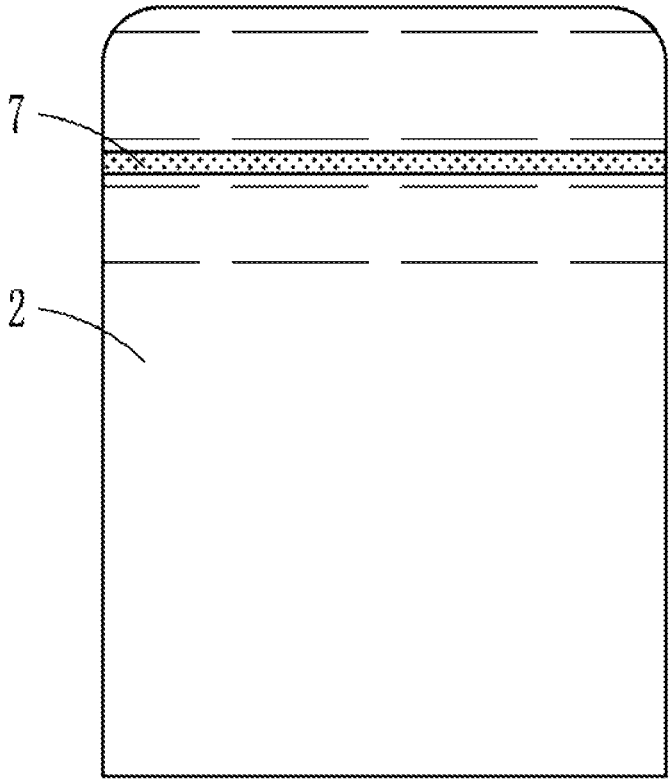
FIG. 4 is a schematic diagram of the surface shape of the contact between Contact Piece of static contact and moving contact blade in an ideal state.
Figure 5:
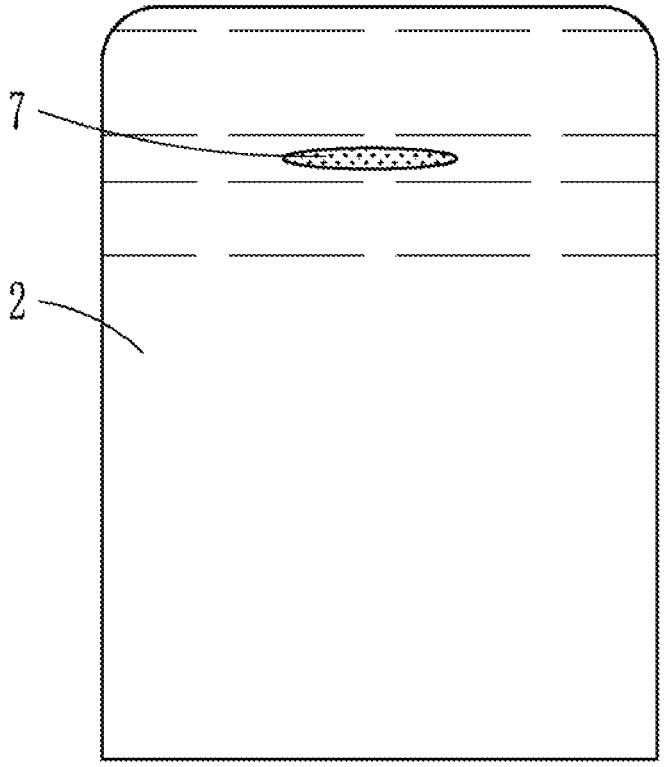
FIG. 5 is a schematic diagram of the actual surface shape of the contact between the Contact Piece of static contact and moving contact blade in the structure of a single group of Belleville springs set on one side.
Figure 6:
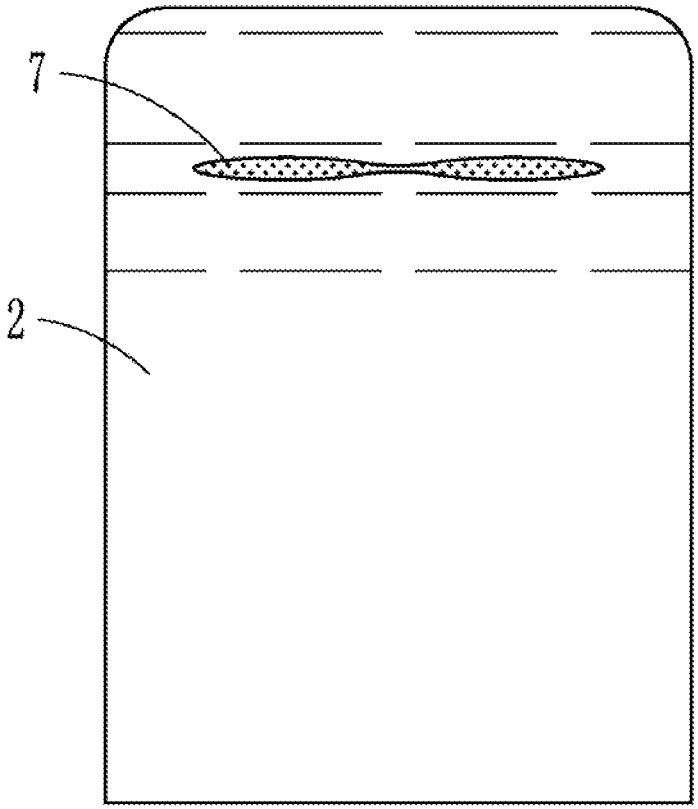
FIG. 6 is a schematic diagram of the actual surface shape of the contact between Contact Piece of static contact and moving contact blade in the structure of two groups of Belleville springs set on both sides mentioned in the present invention.

According to the FIGS. 4-6, in ideal conditions, the contact surface between Contact Piece of static contact and moving contact blade ought to be a narrow and long rectangle. But in fact, the shape of the contact surface has much to do with the stress points. Taking the existing static contact structure with a single group of Belleville springs on one side as an example, the contact surface between the Contact Piece and the moving contact blade is approximately oval, with its widest part longitudinally corresponding to the location of the single group of Belleville springs. In the static contact structure of the present invention disclosed in the above example, the contact surface between Contact Piece and moving contact blade is approximately pillow-shaped, with the two widest points corresponding respectively to the locations of the two groups of Belleville springs.

The examples described above are just some, not all, of the possible applications of this device. Every specific application program based on the ideas of this invention without any creative contribution to it should be regarded as within the range of the protection of this invention.

The following are claims of the previous application, as the basis of the right of priority of this patent application, given here as has been originally recorded for any future modifications of the claims and the specification.

This is a type of power current static contact device of high voltage the earthing switch, including the base, with two Contact Pieces 2 mounted face-to-face on the base and vertical to an upper surface of the base. On the outside of the Contact Pieces 2, there is the supporting plate 3. Its features are: two through-holes not on the same horizontal line are set on the Contact Pieces 2, and the upper part of the supporting plate is firmly connected with the through-holes by two fixed levers 31, while the lower end of the supporting plate is firmly fixed on the base; the Belleville springs 5 is set between the supporting plate 3 and its Contact Piece 2, and Belleville springs 5 is set over the fixed levers 31.

Inside the Contact Pieces 2 there is an extrusion. The upper part of the Contact Pieces 2 is in the shape of an arc which is inwardly extruded. The Belleville springs are in the structure of combination, in which two groups of Belleville springs are linked up with each other. A cushion pad 6, made up of silicon rubber, is set between the two Contact Pieces 2.

The invention claimed is:

1. A strong current contact device for high voltage earthing switch, comprising a base with two placed apart contact pieces mounted face-to-face on the base and vertical to an upper surface of the base, each of outer sides of the two contact pieces is provided with a supporting plate, a lower end of the supporting plate is firmly mounted on the base, characterized in that the strong current contact device consists of two groups of Belleville springs positioned in coaxially stacking are placed between each supporting plate and the contact piece on the same side; wherein axes of the two groups of Belleville springs do not coincide with each other vertically; wherein axes of the two groups of Belleville springs on the same side do not coincide with each other horizontally; and where the horizontal direction is the direction where the upper surface of the base extends, and the vertical direction is the direction vertical to the horizontal direction.

2. The strong current contact device for high voltage earthing switch according to claim 1, wherein axes of the two groups of Belleville springs on the same side coincide with the axes of the two groups of Belleville springs on the other side.

3. The strong current contact device for high voltage earthing switch according to claim 1, wherein two through-holes not on the same horizontal line are provided on the contact pieces, the upper part of the supporting plate is firmly connected with the through-holes by two fixed levers, and each group of Belleville springs is set over a fixed lever.

4. The strong current contact device for high voltage earthing switch according to claim 1, wherein an extrusion is set inside the contact pieces.

5. The strong current contact device for high voltage earthing switch according to claim 1, wherein the upper part of the contact piece is in the shape of an arc which is inwardly extruded.

6. The strong current contact device for high voltage earthing switch according to claim 1, wherein each group of Belleville springs is in the structure of combination, in which two groups of Belleville springs are linked up with each other.

7. The strong current contact device for high voltage earthing switch according to claim 1, wherein a cushion pad is set between the two contact pieces mentioned.

8. The strong current contact device for high voltage earthing switch according to claim 3, wherein the cushion pad is made up of silicon rubber.

* * * * *